United States Patent [19]

Merritt et al.

[11] 4,025,026

[45] May 24, 1977

[54] APPARATUS AND METHOD FOR SUPPLYING CONSTANT TENSION MATERIAL

[76] Inventors: Robert E. Merritt, 832 Country Club Road, Mount Airy, N.C. 27030; E. C. Tibbals, 1906 Pembroke Road, Greensboro, N.C. 27408

[22] Filed: Mar. 11, 1976

[21] Appl. No.: 665,937

[52] U.S. Cl. ..... 226/7; 226/37; 226/97; 226/113; 226/195; 242/185

[51] Int. Cl.[2] ..... B65H 23/18

[58] Field of Search ..... 226/1, 7, 37, 42, 43, 226/95, 113, 97, 195; 242/183, 185

[56] References Cited

UNITED STATES PATENTS

| | | | |
|---|---|---|---|
| 2,862,675 | 12/1958 | MacDonald | 226/97 |
| 3,112,473 | 11/1963 | Wicklund | 226/95 X |
| 3,143,312 | 8/1964 | Harper | 242/185 |
| 3,199,800 | 8/1965 | Reader | 226/97 X |
| 3,254,855 | 6/1966 | Rayfield | 242/185 |
| 3,315,907 | 4/1967 | Jura | 242/185 X |
| 3,507,432 | 4/1970 | Fecher | 226/113 X |

*Primary Examiner*—Richard A. Schacher

[57] ABSTRACT

Apparatus and method for supplying continuous material having a constant tension to a takeup device wherein a constant tension is maintained by passing the material through a vacuum column which controls the material supply and maintains a constant tension prior to the material reaching the takeup device.

16 Claims, 11 Drawing Figures

APPARATUS AND METHOD FOR SUPPLYING CONSTANT TENSION MATERIAL

BACKGROUND AND OBJECTIVES OF THE INVENTION

This invention relates to a new and improved apparatus and method for controlling the tension in continuous filaments or webs of flexible materials such as yarn, paper, cardboard, plastic films, metal foils, wire, and other materials. Users of knitting machines, rotary printing presses, wire-winding devices, and other types of standard equipment are constantly experiencing problems directly related to the tension in the materials that are fed to these machines.

In the past, various tension control devices have been employed utilizing different concepts with varying degrees of success. The earliest tension control devices employed weights suspended from the continuous material to add a constant tension or "drag" on the continuously traveling material. In other applications, springs, gates, clamps as well as electronic, mechanical and electromechanical devices have been employed which apply a frictional force to the material being supplied at the machine takeup. All of the prior devices heretofore known have had various problems including the uneven application of "drag" forces applied to the material. The problem of maintaining a constant and uniform tension on a continuous moving flexible material has been difficult to resolve and has been compounded by the uneven or erratic takeup or consumption of the apparatus to which the material is supplied.

Most tension control devices heretofore devised have operated by applying a frictional force to the continuous material as it is being directed along its feed path. These frictional forces are difficult to regulate and are uneven as the machine which consumes the material operates often in an intermittent as well as in an irregular fashion which compounds the problems of uniform feed at a constant tension.

It is one object of this invention to provide a tension control device which will control delivery of a continuously or intermittently moving material under a uniform and constant tension to the machine takeup where the material is to be consumed or used.

Another object of this invention is to provide a tension control device which will provide equally uniform tensions irrespective of the rate of material travel along a directed path.

Yet another objective of this invention is to provide a tension control device wherein the tension may be easily regulated to a precise degree, irrespective of the surface properties of the material being supplied and is relatively inexpensive to construct.

Still another objective of this invention is to provide a method for controlling the tension uniformly on a continuous material whether traveling continuously or intermittently to a takeup device.

Other objectives of this invention will become readily apparent to one skilled in the art from the following detailed description of the drawings and a preferred embodiment, and the included description and claims are not intended to limit the scope of the invention.

DETAILED DESCRIPTION OF PREFERRED EMBODIMENT OF THE INVENTION

Figure 4:
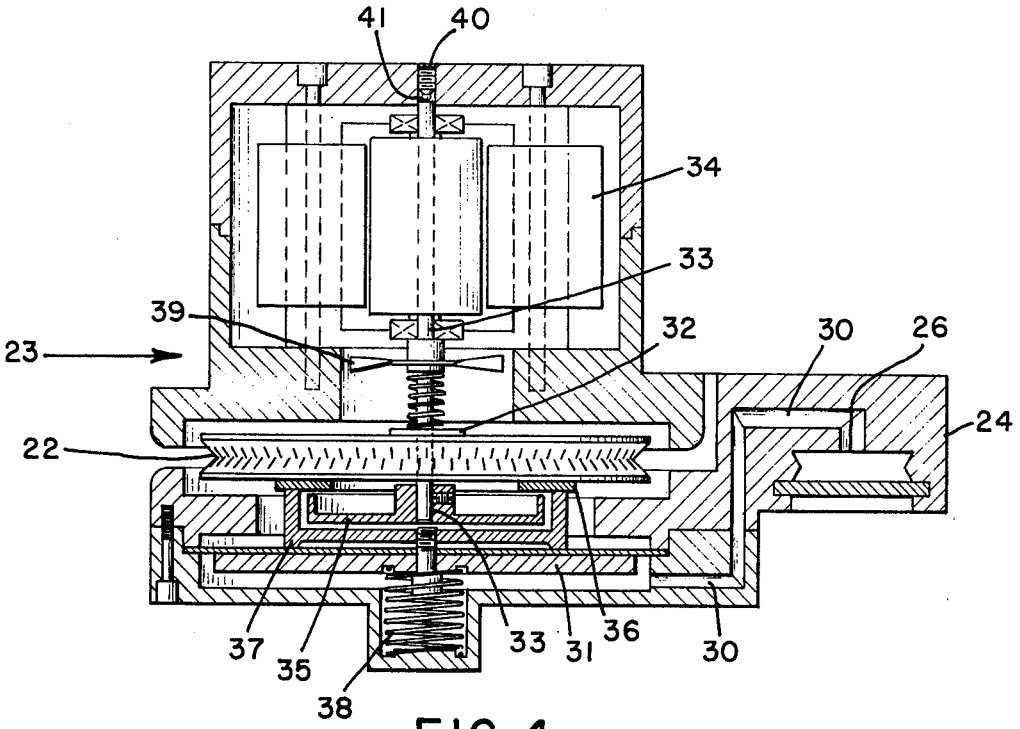
FIG. 4 is a partial cross-sectional view of a feed mechanism embodiment used in conjunction with the vacuum column.

This invention consists of a material feeding device 23 and a vacuum column 24 which controls the rotation of the feeding device 23 that supplies a continuous material 20 to a takeup device (not shown) at a uniformly constant tension irrespective of the takeup device supply demand whether intermittent or continuous.

The feeding device 23 employs a motor-driven feed wheel 22 which engages material to be fed and positively directs the material along a directed path of travel into a vacuum column 24.

The material 20 engages a column ring or disc 25 inside vacuum column 24, and column disc 25 freely is displaceable vertically inside vacuum column 24 depending upon the fluid pressure or suction force applied to displaceable disc 25.

A sensor port is positioned in the vacuum column 24 permitting fluid pressure or a suction force emanating from vacuum port 27 to be applied to sensor port 26 at such times as column disc 25 is positioned below sensor port 26. At other times, when column disc 25 is level with or above the sensor port 26 in the vacuum column 24, the disc 25 blocks or prevents the force of suction from being applied to sensor port 26. Consequently, only column disc 25 is affected by the suction action when it is positioned above sensor port 26. When the column disc 25 is below sensor port 26, thereby allowing suction action to be applied to the sensor port, feeding device 23, which is in communication with vacuum column 24, is activated and additional material 20 is fed into vacuum column 24 permitting additional material to be supplied to the takeup device under a uniform and constant tension. When column disc 25 is above sensor port 26, preventing feeding device 23 to be activated, no additional material 20 is fed into vacuum column 24.

Therefore, as will be seen below, the position of column disc 25 can be either (1) below the sensor port 26, (2) level with it, or (3) in a position above it, and the position of column disc 25 of either condition (a) or (2) causes the feeding device to direct additional yarn into vacuum column 24. In position (3), feeding device 23 is inoperative to supply material to the vacuum column.

Figure 1:
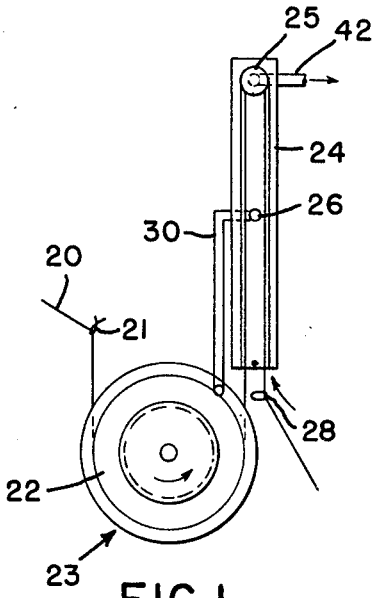
FIG. 1 shows a front elevational schematic view of a preferred embodiment of the invention in which a continuous strand of yarn is supplied to a takeup device under a constant tension as it leaves a vacuum column chamber.

Referring to FIG. 1, for a more detailed description of the invention, the material to be supplied under a uniform and constant tension is in the form of a continuous yarn 20 which is to be fed under constant tension to a machine takeup (not shown). Yarn 20 is a typical continuous textile yarn such as polyester, nylon, or cotton and is shown passing through guide means 21 for engagement with feed wheel 22 in the feeding means 23. After departing from feed wheel 22, the yarn is then directed upwardly into vacuum column 24 and around column disc 25 prior to exiting from the vacuum column 24 through guide means 28. Sensor port 26 is shown midway along the height of the vacuum column 24, and column disc 25 is shown in its uppermost position inside vacuum column 24 in FIG. 1.

Figure 2:
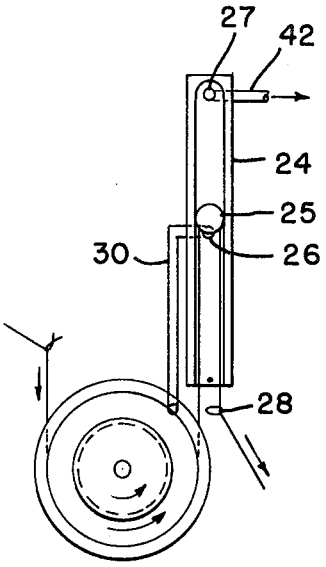
FIG. 2 is another view of the device shown in FIG. 1 with the column ring shown in a lower position in the column chamber than shown in FIG. 1.

In FIG. 2, column disc 25 is shown slightly above the center of sensor port 26 and well below vacuum port 27. While the column disc 25 is in this position, sensor port 26 will not receive any suction force from vacuum port 27 and consequently, no additional yarn 20 will be fed from feeding means 23 to the vacuum column 24.

Figure 3:
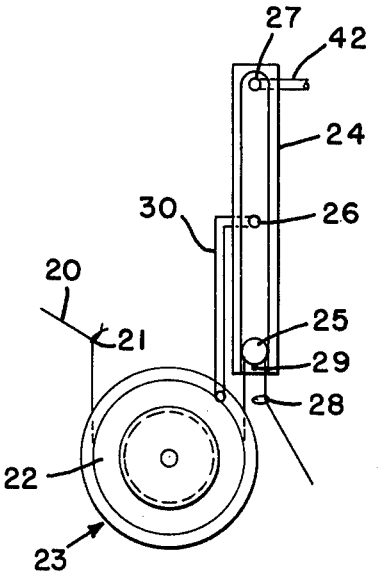
FIG. 3 illustrates the column ring at its lowermost position in the column chamber in the front elevational view as is shown in FIGS. 1 and 2.

In FIG. 3, column disc 25 is shown in its lowermost position and is resting on disc stop 29 which prevents the column disc from dropping out of the open end of vacuum column 24 during those periods when the apparatus is not in use.

When operation of the apparatus is resumed, column disc 25 will initially be in its lowermost position as depicted in FIG. 3, but will be elevated in the vacuum column 24 proportionally with the force of the suction applied from vacuum port 27. Feeding means 23 will supply additional yarn 20 to vacuum column 24 until such time as column disc 25 isolates sensor port 26 by rising to a vertical height above sensor port 26.

Referring to FIG. 4, feeding means 23 and vacuum column 24 are shown with the sensor port 26 in direct communication with feeding means 23 through conduit 30. The vacuum or suction force which is applied to sensor port 26 is transmitted to diaphragm support plate 31 and will cause additional yarn to be fed to vacuum column 24 as more fully described below. The feed wheel 22 shown in FIG. 4 is mounted by bearings 32 on motor shaft 33.

When motor 34 is activated, the drive shaft 33 rotates and in turn rotates clutch wheel 35 which is rigidly affixed to the drive shaft 33. The clutch wheel 35 shown in FIG. 4 is disengaged from driving plate 36 and no yarn is fed until clutch wheel 35 engages driving plate 36. Column disc 25 would be positioned level with, or above vacuum port 26, for the clutch wheel 36 to remain in the disengaged position.

During operating periods when the feed wheel 22 is revolving and supplying additional yarn 20 to the vacuum column 24, clutch wheel 35 engages driving plate 36 and the position of the column disc 25 is below sensor port 26 so that suction force is applied to diaphragm support plate 31 as mentioned earlier. Diaphragm support plate 31 moves axially away from feed wheel 22 in this embodiment as it receives a vacuum force through conduit 30 thereby withdrawing brake ring 37 from driving plate 36 and allows engagement of clutch wheel 35. As shown in FIG. 4, when brake ring 37 engages the driving plate 36, the feed wheel 22 does not rotate to supply additional yarn. The brake spring 38 urges the diaphragm support plate 31 inwardly toward the motor 34 and forces the feed wheel 22 to stop rotating as the vacuum force in conduit 30 diminishes.

The motor fan blades 39 are affixed to the drive shaft 33 and rotate during the operation to prevent the motor 34 from overheating. The clutch adjustment screw 40 is tightened on clutch thrust bearing 41 for proper positioning of clutch wheel 35 on the drive shaft 33.

Figure 5:
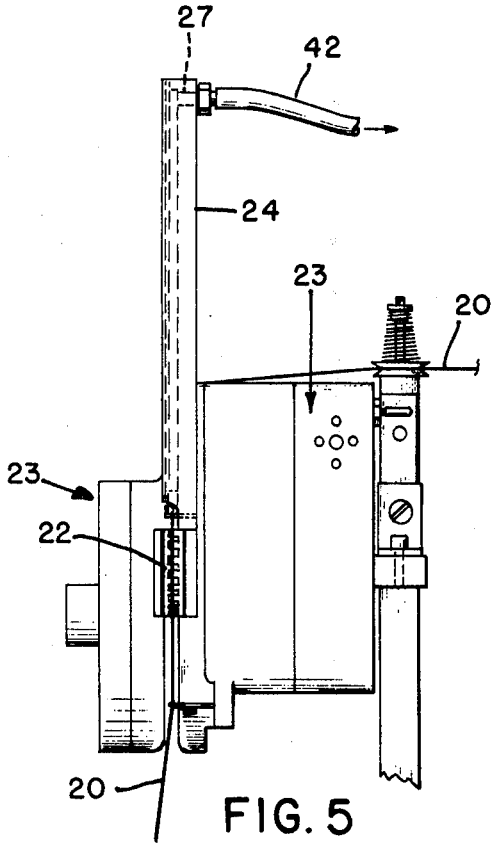
FIG. 5 is a side elevational view of the tension control device with the feed mechanism assembly.
Figure 6:
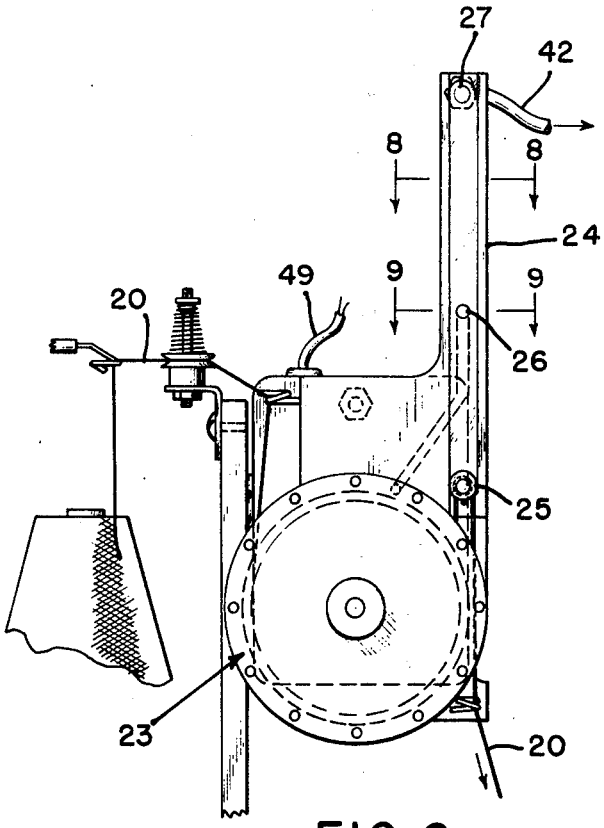
FIG. 6 is a front elevational view of FIG. 5 including a partial view of a yarn supply package from which yarn is fed to the tension control device.
Figure 8:
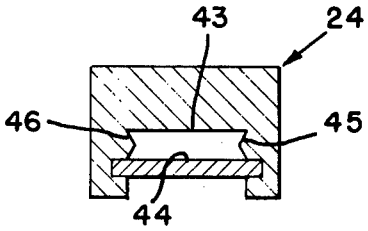
FIG. 8 is an enlarged cross-sectional view of the vacuum column.
Figure 9:
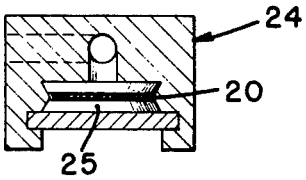
FIG. 9 is an enlarged cross-sectional view of the vacuum column with a column ring positioned within the vacuum column.

The vacuum column 24, shown in FIG. 5, is provided with a vacuum hose 42 that is connected at one end to any suitable adjustable vacuum source (not shown) and the opposite end is connected to the vacuum port 27. Column 24 in FIG. 8 is shown without the column disc 25 positioned therein. Opposite interior column wall pairs 43, 44 and 45, 46 are erected in parallel relationship, and the vacuum pressure will exert the same force on column disc 25 at any position above the sensor port due to the parallel construction of the interior walls which make up the vacuum column 24.

Figure 10:
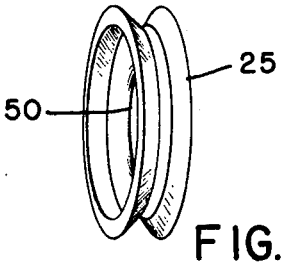
FIG. 10 is a perspective view of the column ring.
Figure 11:
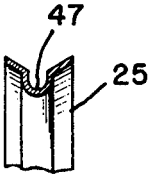
FIG. 11 is a partial enlarged transverse sectional view of the upper section of the column ring of FIG. 10.

A typical, relatively lightweight column disc 25 is shown in FIG. 10 with the center groove 47, shown in FIG. 11, around which the yarn 20 freely passes in a manner to prevent lodging or wedging.

Figure 7:
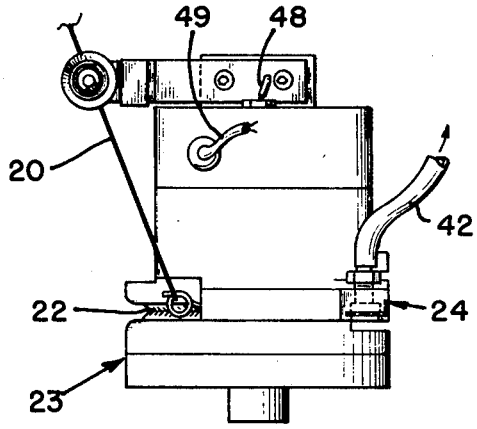
FIG. 7 is a top view of the tension control device and feed mechanism assembly of FIG. 5.

The motor 34 may be turned on or off by the toggle switch 48 as shown in FIG. 7, and the switch 48 is connected to an electric supply through the electric cord 49.

Other embodiments of this invention may be constructed which will accommodate various forms and shapes of materials to be supplied under a constant, uniform tension to a takeup device. The materials from which the vacuum column 24 is constructed may be of a suitable plastic and the front wall 44 is preferably clear to enable one to view the relative position of the disc 25. The disc 25 is preferably made of plastic with a central opening 50, and the size of this opening has been found to relate directly to the ability to easily control the tension of yarn 20.

It is often advantageous to supply a plurality of materials under a constant, uniform tension and this can be accomplished either by having a series of tension control devices each of which supply, for example, one strand of yarn or by controlling the tension of a plurality of individual yarn strands by permitting them to simultaneously pass through the same vacuum column and over the same vacuum disc prior to being received by the machine takeups.

We claim:

1. Apparatus for supplying a continuous filament or web of material under a constant uniform tension to a takeup comprising: a column for receiving said material along a directed path of travel and having material inlet and exit means, said column having a chamber through which said material passes, means in said column chamber for engaging a material passing therethrough and exerting a load thereon, said material engaging means having a groove around which said material freely passes, fluid means connected to said chamber urging said material and said material-engaging means to be displaced in response to the rate of material removal by said takeup, a material supply means for feeding material to said column, material supply control means between said column chamber and said material supply means for controlling the rate of material supply to said chamber responsive to the displacement of said material and said material-engaging means in said chamber to supply said material under a constant uniform tension to the takeup as said material exists from said chamber.

2. Apparatus as claimed in claim 1, wherein said walls of said column chamber are vertically aligned and parallel.

3. Apparatus as claimed in claim 1, wherein said material-engaging means is a disc.

4. Apparatus as claimed in claim 1, wherein said material-engaging member is a weighted circular ring.

5. Apparatus as claimed in claim 1, wherein said fluid means is a vacuum.

6. Apparatus as claimed in claim 1, wherein said material supply means includes a feeding means.

7. Apparatus as claimed in claim 1, wherein said material supply control means is a vacuum.

8. Apparatus as claimed in claim 1, wherein said material supply means comprises an electric motor, said motor having a rotatable drive shaft, said drive shaft being affixed to a clutch means and to a braking means, said braking means having a diaphragm member and a resilient member in juxtaposition to said column chamber and with said resilient member, and a feed wheel axially mounted on said drive shaft whereby a vacuum force in said column will act on said diaphragm to disengage said brake and engage said clutch thereby causing said feed wheel to rotate and to supply material to said material engaging means in said column and thereafter out of said column under a constant uniform tension to a material takeup.

9. Apparatus as claimed in claim 8, wherein said electric motor is a constant-speed electric motor.

10. Apparatus as claimed in claim 8, wherein said resilient member urges said diaphragm against said braking means whereby said clutch means is disengaged to prevent the rotation of said feed wheel.

11. A method for supplying a continuous filament or web of material to a takeup under a constant uniform tension comprising: the steps of feeding material along a directed path of travel from a source of material supply, subjecting said material along its direct path of travel to fluid pressure in a confined chamber, passing said material around a grooved displaceable member in said chamber for displacement therein with said material, removing said material from said chamber to a material takeup, and controlling the supply of material fed to said chamber in response to the displacement of said displaceable member and said material in said chamber.

12. A method for supplying a continuous filament as claimed in claim 11, and subjecting said material to the forces of suction along its directed path of travel.

13. A method for supplying a continuous filament web as claimed in claim 11, and retaining a displaceable ring memeber on said material during material displacement.

14. A method for supplying a continuous filament or web of material as claimed in claim 11, controlling the supply of material fed to said chamber by a suction force.

15. A method for supplying a continuous filament or web of material as claimed in claim 11, and feeding the material along a directed path of travel from a material supply spool, engaging said material in a circular path of travel, and controlling the rate of pull of said circular path of travel.

16. A method for supplying a continuous filament or web of material as claimed in claim 15, controlling the rate of rotation by disengaging a brake means by suction means, engaging a clutch means, and rotating said clutch means by a motor means.

* * * * *